US006059618A

United States Patent [19]

Purnell et al.

[11] Patent Number: 6,059,618

[45] Date of Patent: May 9, 2000

[54] VENTILATED OUTBOARD MOTOR-MOUNTED PUMPJET ASSEMBLY

[75] Inventors: John G. Purnell, Catonsville; Alan J. Becnel, Annapolis, both of Md.

[73] Assignee: The United States of America as represented by the Secretary of the Navy, Washington, D.C.

[21] Appl. No.: 09/207,518

[22] Filed: Dec. 9, 1998

[51] Int. Cl.[7] ..... B63H 11/00

[52] U.S. Cl. ..... 440/38; 440/67

[58] Field of Search ..... 440/38, 47, 66, 440/67; 416/179, 189, 192; 60/221

[56] References Cited

U.S. PATENT DOCUMENTS

| | | | |
|---|---|---|---|
| 3,658,028 | 4/1972 | Koons . | |
| 3,672,169 | 6/1972 | Ufer . | |
| 3,849,982 | 11/1974 | Hall . | |
| 3,939,794 | 2/1976 | Hull . | |
| 4,023,353 | 5/1977 | Hall . | |
| 4,304,558 | 12/1981 | Holtermann . | |
| 4,533,331 | 8/1985 | Bland . | |
| 4,637,801 | 1/1987 | Schultz | 440/67 |
| 4,694,645 | 9/1987 | Flyborg et al. . | |
| 4,776,755 | 10/1988 | Bjorkestam et al. . | |
| 4,789,302 | 12/1988 | Gruzling . | |
| 4,832,634 | 5/1989 | Kearns . | |
| 4,931,026 | 6/1990 | Woodland | 440/38 |
| 4,992,999 | 2/1991 | Yerby et al. . | |
| 4,993,977 | 2/1991 | Rodler, Jr. . | |
| 5,145,428 | 9/1992 | Harrison . | |
| 5,273,467 | 12/1993 | Hall . | |
| 5,389,021 | 2/1995 | Padgett | 440/67 |
| 5,445,545 | 8/1995 | Draper . | |
| 5,482,482 | 1/1996 | Davis . | |
| 5,588,886 | 12/1996 | Davis . | |
| 5,667,415 | 9/1997 | Arneson . | |

*Primary Examiner*—Stephen Avila
*Attorney, Agent, or Firm*—Howard Kaiser

[57] ABSTRACT

The invention features a unique surface configuration which fosters atmospheric ventilation and thereby uncomplicatedly reduces drag which is normally associated with implementation of shrouding for a marine impeller. Typical inventive embodiments include a blunt trailing edge and a circumferentially stepped impeller shroud (below the blunt trailing edge), the harmonious union of which affords a generally smooth and unbroken surface which encourages drag-defeating air circulation. During marine navigation, circulation of the air generally describes a path wherein the air first travels linearly downward along the blunt trailing edge, then travels curvingly downward (both clockwise and counterclockwise) along the circumferential step, forming a circumferential air pocket which extends a backward distance increasing in accordance with increasing navigational speed; upon attainment of a threshold navigational speed, the air pocket (virtually) completely surrounds the shroud. According to the invention, many a conventional outboard open propeller assembly can be facilely converted to an inventive outboard shrouded impeller assembly which produces equal or superior performance.

18 Claims, 15 Drawing Sheets

VENTILATED OUTBOARD MOTOR-MOUNTED PUMPJET ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to marine propulsion, more particularly to methods, apparatuses and systems for effectuating marine propulsion which implements one or more pumpjet-type propulsors.

Open propellers on outboard motors represent a hazardous condition. This potential for personal injury due to open propellers has provided impetus for the development of pumpjet-type propulsors which enclose the rotating elements of the thruster. The application of pumpjets to outboard motors is a relatively recent development.

An outboard motor-mounted pumpjet (alternatively spelled "pump-jet" or "pump jet") propulsor is capable of performance which is comparable to, or even exceeds, that of a suitably designed open propeller. However, one of the drawbacks associated with pumpjet implementation is the increase in wetted surface area due to the presence of the shroud (duct) around the impeller; this increased wetted surface area results in increased lower unit drag. This drag phenomenon limits maximally attainable craft speed and otherwise impairs craft performance.

Various approaches have been proposed for alleviating the drag problem attendant pumpjet propulsion. Such approaches have generally involved complexities which may be undesirable for practical or economic reasons. For instance, utilization of special ducting has been conceived for purposes of directing air or engine exhaust to the shroud area or nozzle area of the pumpjet.

In the early 1990's, the U.S. Navy's Naval Surface Warfare Center, Carderock Division (NSWCCD), was tasked (in a private intragovernmental context) by the U.S. Marine Corps (USMC) to develop an improved pumpjet. The 35 SHP outboard pumpjet, which was commercially acquired and used by the USMC at that time, performed well but was characterized by certain performance penalties when compared to an open propeller used on the same outboard motor. This endeavor by the U.S. Navy to improve pumpjet performance has led to the present invention.

SUMMARY OF THE INVENTION

In view of the foregoing, it is an object of the present invention to provide method, apparatus and system for decreasing drag associated with utilization of pumpjets.

It is a further object of this invention to provide such method, apparatus and system which are relatively devoid of complexity.

In September of 1995, NSWCCD delivered to the USMC a prototype pumpjet unit which, in a sense, represented a precursor of the present invention. That prototype pumpjet unit utilized a stepped shroud which was fed by ducted engine exhaust. The present invention was initially conceived during this time frame in September of 1995. The inventors first envisioned, in accordance with the present invention, ventilation of the stepped shroud with atmospheric air by means of an arrangement implementing a blunt trailing edge down to the shroud's step.

In accordance with many embodiments of the present invention, a propulsion assembly is provided for an outboard motor which is situated in the vicinity of the stern of a marine vessel. The marine vessel has associated therewith a fore, an aft and a centerline. The inventive propulsion assembly comprises an impeller device and a member. The member extends generally downward from the outboard motor and joins the outboard motor with the impeller device. The impeller device includes a covering. The covering is approximately symmetrical about an axis which is approximately parallel to the marine vessel's centerline.

The combination of the member and the covering includes a generally aft-facing surface which is at least substantially continuous. The aft-facing surface includes an approximately linear first surface portion and a curvilinear second surface portion.

The first surface portion is approximately perpendicular to the axis and extends an "effective" distance above the waterline. In typical inventive practice, the first surface portion extends at least several inches (e.g., at least on the order of six to twelve inches) above the waterline. The distance which the first surface portion extends above the waterline should be sufficient for effecting downward air flow during navigation, thereby promoting the fluid dynamic principles of the present invention. For many inventive embodiments, the first surface portion at least substantially extends between the outboard motor and the covering.

The second surface portion is curvilinear and at least substantially encircles the covering's axis. For many inventive embodiments, the member includes at least a substantial part of the first surface portion. The covering includes at least a substantial part of the second surface portion. When the marine vessel travels, atmospheric air circulates along the aft-facing surface so as to ventilate the covering, thereby reducing drag related to the covering.

The present invention thus provides a unique methodology which serves to ventilate the pumpjet's shroud exterior with atmospheric air, thereby reducing lower unit drag, attaining higher craft speeds and improving performance. Featured by the present invention is a continuous (or substantially continuous), generally aft-facing surface configuration which is afforded by an inventive arrangement involving a blunt trailing edge housing and a stepped shroud.

The term "covering" is used interchangeably herein with the terms "shroud" and "duct" and refers to a structure which is generally of the type which surrounds, encloses or contains a propulsor.

The inventively featured aft-facing surface initially proceeds downward from a location at or near the motor unit in an approximately linear path, then loops around (or substantially around) the shroud in a curvilinear path. The approximately linear path meets the curvilinear path at a location which is approximately the maximum ("twelve o'clock") point of the curvilinear path, thereby merging into the curvilinear path in two opposite directions, viz., a clockwise direction and a counterclockwise direction.

For some inventive embodiments, a bottom portion of the impeller device "interrupts" the continuity of the aft-facing surface at a location which is approximately the minimum ("six o'clock") point of the curvilinear path. For instance, a skeg-like portion situated at "six o'clock" should not be significantly disruptive of the air circulation.

When the marine vessel moves, the inventive aft-facing surface guides the flow of ambient air generally downward in such a way as to initially advance along the approximately linear path, then approximately concurrently advance around the curvilinear path in both the clockwise direction and the counterclockwise direction. A "vapor cavity" (alternatively referred to herein as an "air pocket") is formed along the aft-facing surface, particularly along the circumferential portion of the aft-facing surface.

The vapor cavity is induced while the marine vessel is underway; that is, the vapor cavity draws in surface air, and thereby unwets, a substantial aft portion of the stepped shroud. To a point, the vapor cavity extends a distance aftward in accordance with the speed of the marine vessel. When a sufficient speed is achieved (a sort of "threshold" speed in terms of envelopmental entirety), the vapor cavity extends sufficiently aftward to completely (or substantially) surround the shroud; in fact, at sufficient speeds the vapor cavity extends aftward an appreciable distance beyond (behind) the aft end of the shroud. In this manner, while the marine vessel is in motion, the exposed portion of the pumpjet's shroud exterior becomes enveloped, like a sheath or blanket, with atmospheric air.

The inventive aft-facing surface's dual attributes of "continuity" and "evenness" represent an important aspect of this invention. According to this invention, the circulation of the atmospheric air should, to a substantial degree, take a smooth, unbroken course and therefore entail a steady, uninterrupted process. For inventive practice it is sufficient that the inventive aft-facing surface have sufficient "continuity" and "evenness" for permitting the entirely unimpeded, or substantially unimpeded, flow of air between the topmost area of the inventive aft-facing surface and the bottommost area of the inventive aft-facing surface.

In this regard, the inventive aft-facing surface should not unduly deviate from a smooth, planar (flat or level) contour. Protrusions, recesses, excessive curvature or other irregularities in the aft-facing surface are generally sought to be avoided. A possible exception would be an irregularity (e.g., a skeg-like or other protrusive structure) which is situated in the topmost area or bottommost area of the inventive aft-facing surface and which therefore negligibly affects the top-to-bottom air flow.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described by way of example, with reference to the accompanying drawings, wherein like numbers indicate the same or similar components, and wherein.

DETAILED DESCRIPTION OF THE INVENTION

Figure 1:
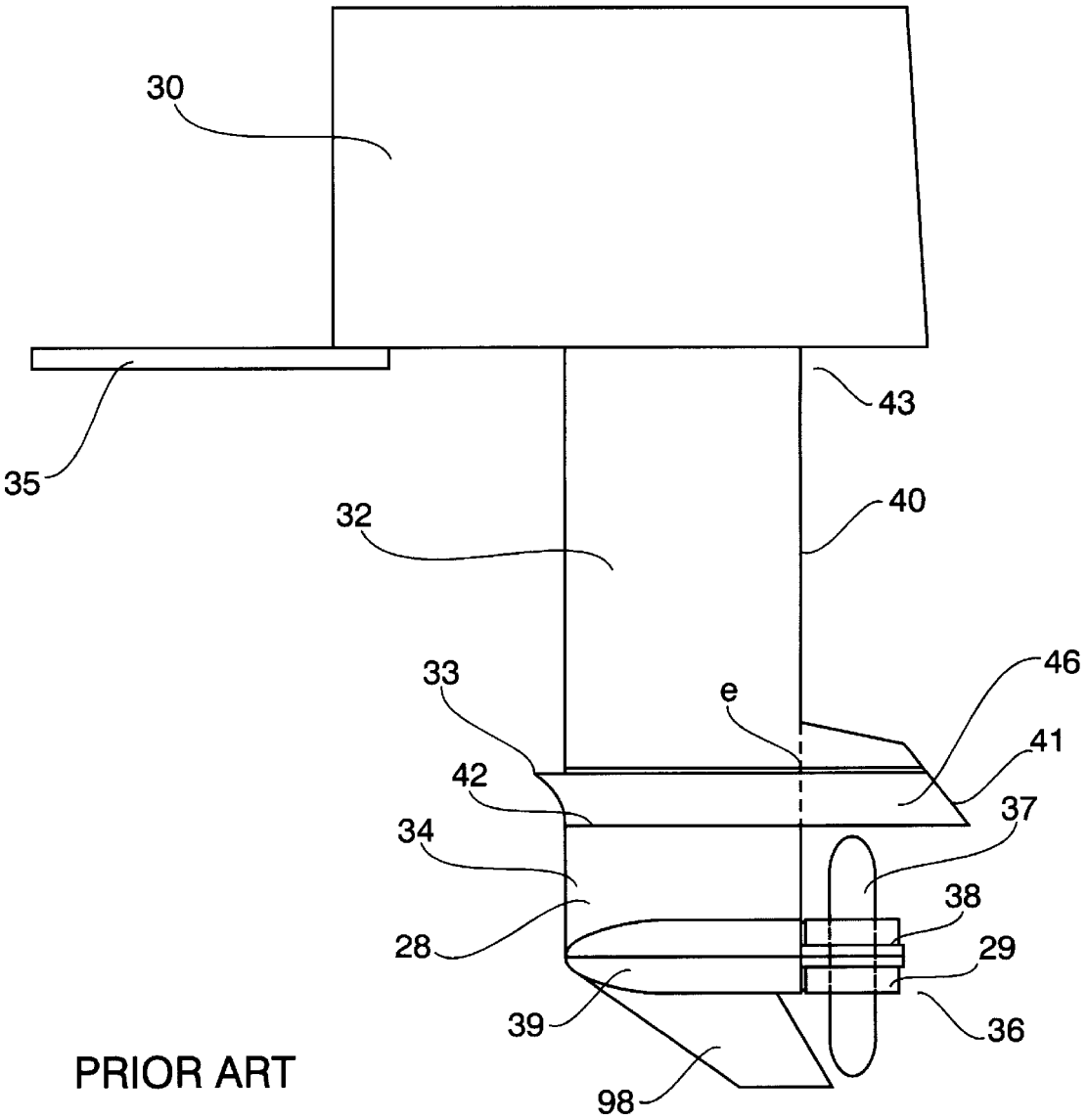
PRIOR ART FIG. 1
FIG. 1 is a diagrammatic side elevational view of a typical outboard propeller arrangement.
Figure 2:
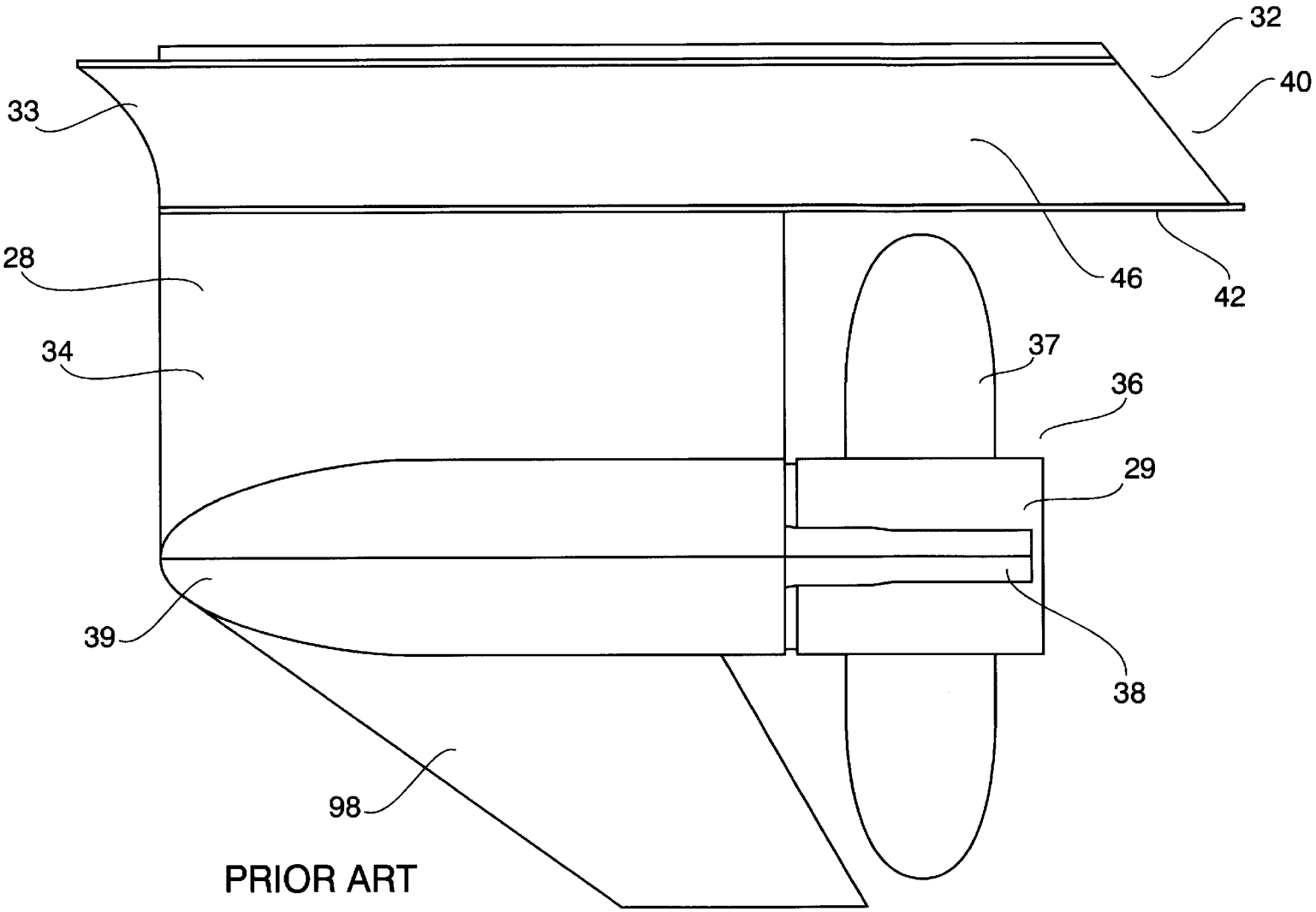
FIG. 2 is a partial and enlarged version of the view shown in FIG. 1.

Referring now to FIG. 1 and FIG. 2, a conventional commercially available outboard propeller arrangement can be considered to comprise three sections. The upper section, referred to herein as motor 30, is commonly called the "powerhead." The intermediate section is a strut-like structure referred to herein as motor strut 32. The lower section, which includes gearing and the propulsor, is referred to herein as lower gearcase unit 34. Generally speaking, in terms of engine mechanics, a transmission shaft takes the drive from the lower end of a vertical driveshaft (crankshaft) and drives a propeller via a gearbox and a propeller shaft.

Motor strut 32 connectively projects generally downward from motor 30 and supports lower gearcase unit 34, situated generally beneath motor strut 32. A steering connection such as tiller 35 engages motor 30 and steers the marine vessel.

Lower gearcase unit 34 includes an integral structure which comprises arm portion 28, "bullet"-shaped nosecone portion 39 and skeg portion 98. Lower gearcase unit 34 also includes open propeller unit 36, which comprises propeller 37, rotatable propeller shaft 38 (to which propeller 37 is attached) and hub 29.

Motor strut 32 and lower gearcase unit 34 are together configured so as to have jagged trailing edge 40 which, as it proceeds downward, erratically angles aftward and forward. Jagged trailing edge 40 is indicated to have a top end 43 and a bottom end 41. Cavitation plate 42 and spray deflector 33 are considered herein to be included in lower gearcase unit 34. Spray deflector 33, above Cavitation plate 42, establishes the upper demarcation of lower gearcase unit 34 vis-a-vis' motor strut 32.

Cavitation plate 42 is protrusive on three sides (aft, port and starboard), extending aftward slightly or somewhat beyond the point at which it is met by the lower oblique edge segment of trailing edge 40. Cavitation plate 42 extends aftward, over and beyond propeller 37, in order to prevent atmospheric air being drawn down and into open propeller 37. A portion of gearcase unit 34 which is designed for including an open propeller unit 36 is connected almost seamlessly under cavitation plate 42.

Figure 3:
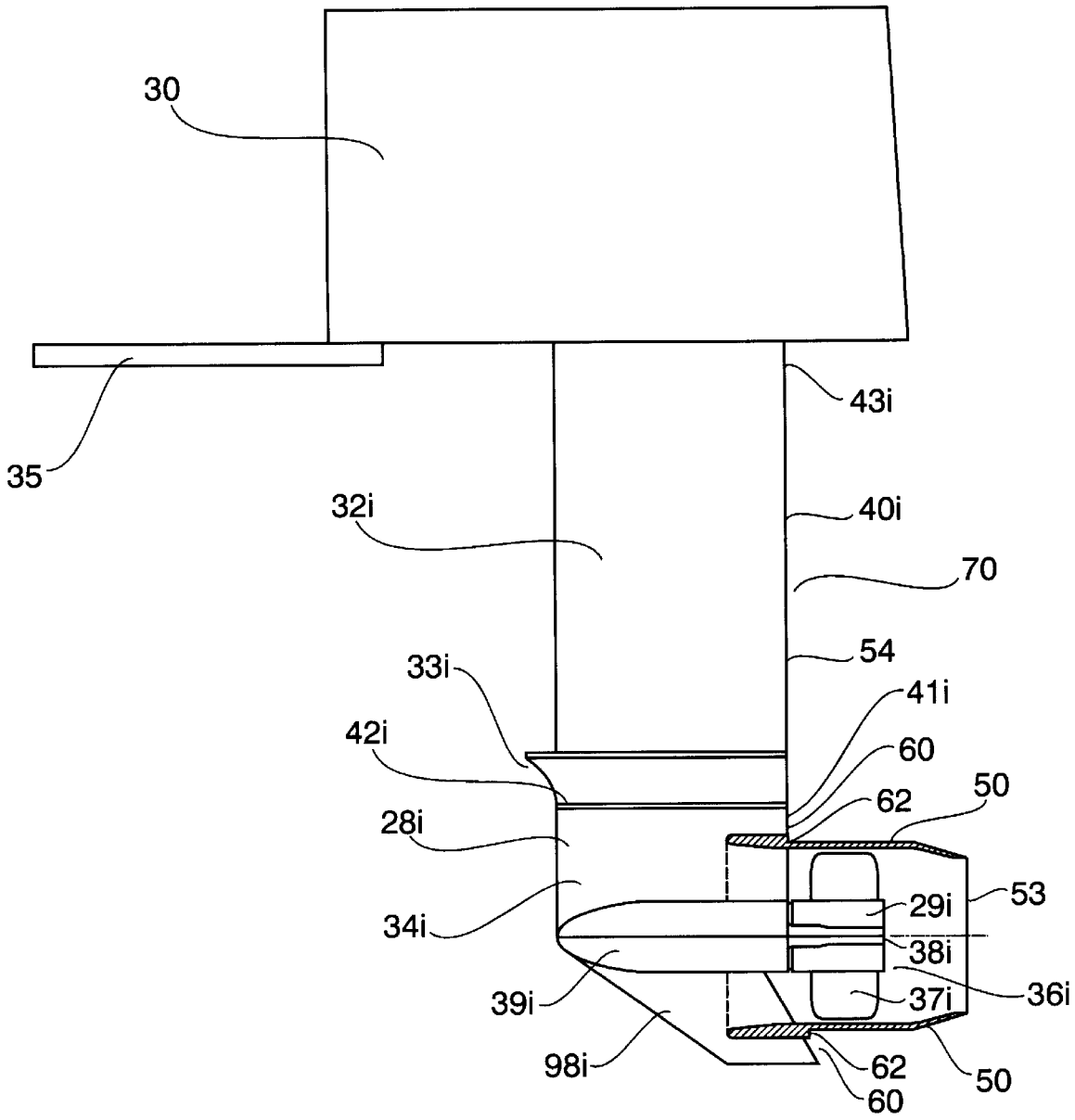
FIG. 3 is a diagrammatic side elevational view, partially in section, of an embodiment of an outboard pumpjet arrangement in accordance with the present invention, wherein the bottom area of the shroud's step is aft of the top area thereof.
Figure 4:
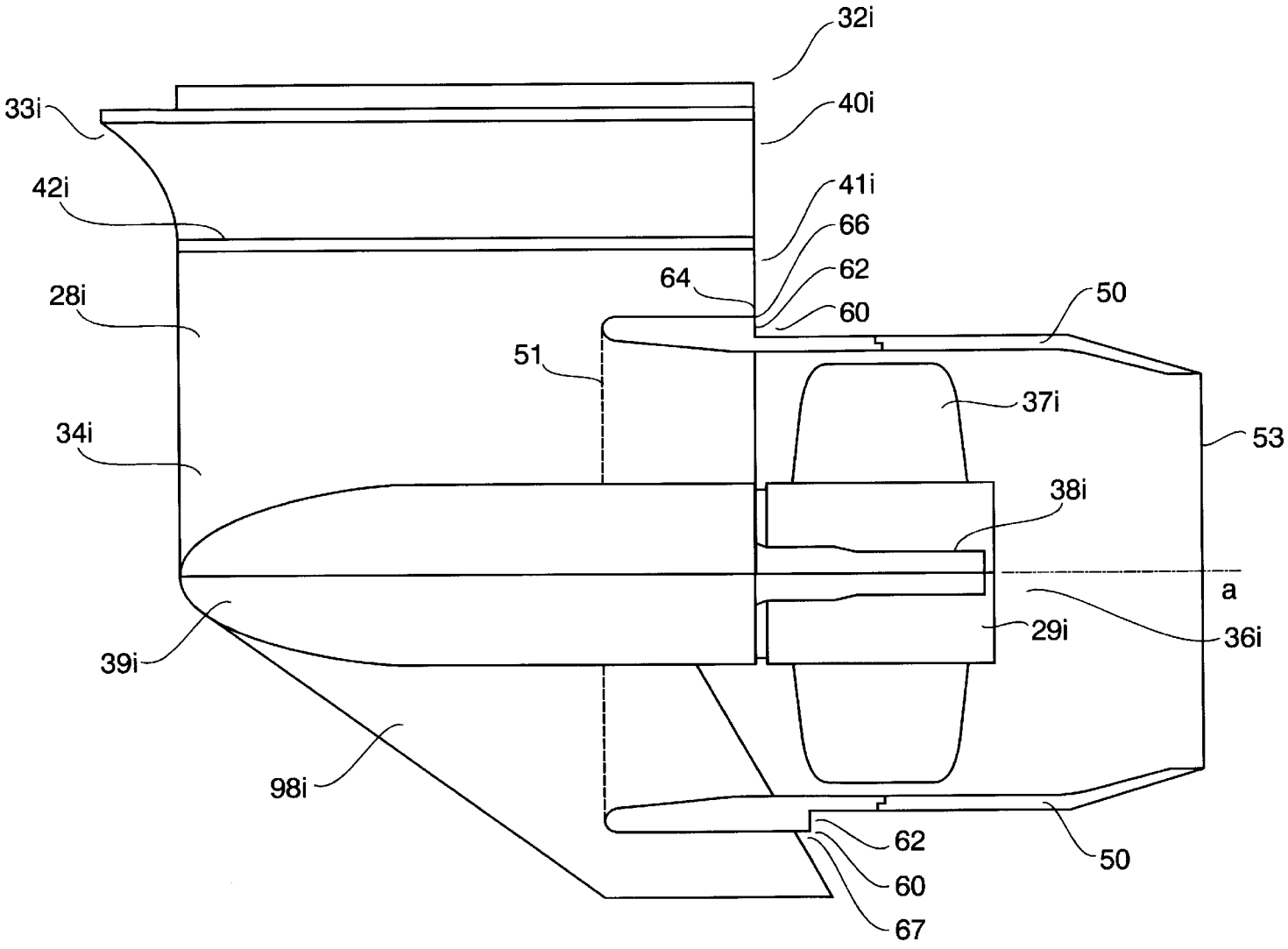
FIG. 4 is a partial and enlarged version of the view shown in FIG. 3.

Still with reference to FIG. 1 and FIG. 2 and now with reference to FIG. 3 and FIG. 4, a conventional outboard propeller configuration which includes open propeller unit 36 has been converted to an inventive outboard pumpjet configuration which includes pumpjet unit 36*i*. Certain changes have been effectuated for purposes of producing motor strut 32*i* and gearcase unit 34*i*. Collectively considered, these changes are both structural and mechanical in nature. As shown in FIG. 3 and FIG. 4 and several other figures herein, the intermediate section of the propulsion system is now motor strut 32*i*, and the lower section of the propulsion system is now lower gearcase unit 34*i*.

The inventive transformation of the open propeller arrangement such as shown in FIG. 1 and FIG. 2 into a shrouded impeller arrangement involves more that merely backfitting a pumpjet unit onto the commercial outboard motor components, since these components have originally been developed for open propeller use. If lower gearcase unit 34*i* were to be implemented in association with motor strut 32 shown in FIG. 1 and FIG. 2, the additional wetted surface area of shroud 50 would still significantly increase the drag, especially as the speed of the marine craft increases. Accordingly, the inventive transformation also necessitates removal of extended cavitation plate region 46, delimited by vertical dashed line e in FIG. 1. As shown in FIG. 1, extended cavitation plate region 46 is the protrusive structural aft region of motor strut 32 and lower gearcase unit 34.

The present invention can be made retrofittingly (i.e., vis-a-vis' commercial outboard motor open propeller assemblies) and/or developmentally (e.g., by manufacturing inventively harmonious motor strut and gearcase unit components from scratch). The inventive pumpjet design is simplified overall, as compared with the conventional open propeller design, by virtue of the elimination of extended cavitation plate region 46.

Motor strut 32*i* and lower gearcase unit 34*i* are provided with blunt trailing edge 40*i*. Lower gearcase unit 34*i* includes cavitation plate 42*i*. Extended cavitation plate region 46 shown in FIG. 1 (and partially shown in FIG. 2) has inventively been removed. In general, according to inventive design, cavitation plate 42*i* must only be of sufficient length to prevent air ingestion at shroud inlet 51 to pumpjet 36*i*. Shroud inlet 51 is well forward of blunt trailing edge 40*i*, thus insuring fluid dynamic viability of blunt trailing edge 40*i*.

Stepped shroud 50 has been added. Hence, lower gearcase unit 34*i* includes an integral structure which comprises arm portion 28*i*, spray deflector 29*i*, "bullet"-shaped nosecone portion 39*i*, skeg portion 98*i* and stepped shroud 50. Stepped shroud 50 is an especially notable inventive attribute of lower gearcase unit 34*i*.

Furthermore, propeller 37 shown in FIG. 1 and FIG. 2 has been replaced by impeller 37i. Thus, lower gearcase unit 34*i* includes inventive pumpjet unit 36*i*. Open propeller unit 36 has become inventive pumpjet unit 36*i* which includes impeller 37*i*, shaft 38*i* and hub 29*i*.

Inventive adaptation of motor strut 32 and lower gearcase unit 34 is in furtherance of producing motor strut 32*i* and lower gearcase unit 34*i* having blunt trailing edge 40*i*. Moreover, inventive adaptation of lower gearcase unit 34 is in furtherance of providing stepped shroud 50 and holding pumpjet unit 36*i*.

Motor strut 32*i* projects generally downward from motor unit 30 and supports lower gearcase unit 34*i*. Stepped shroud 50, a curvilinear covering characterized by approximate axial symmetry (e.g., cylindroid or quasi-cylindrical), is made an integral part of gearcase unit 34*i* and accommodates impeller 37*i*.

Still referring to FIG. 3 and FIG. 4 and also referring to FIG. 5 through FIG. 9, aft-facing surface 70, which comprises edge face 54 and step face 62, constitutes the inventive fluid dynamic surface which permits and promotes the advantageous drag-attenuating ventilation of lower gearcase unit 34*i*, in particular of shroud 50. In terms of outline shape, an analogy can be drawn between aft-facing surface 70 and an inverted lollypop.

Blunt trailing edge 40*i* is disposed in motor strut 32*i* and in the lower gearcase unit 34*i*. The top end 43*i* of blunt trailing edge 40*i* is located on motor strut 32*i* at a point just below motor 30; the bottom end 41*i* of blunt trailing edge 40*i* is located on lower gearcase unit 34*i* at a point somewhat below the bottom of motor strut 32*i*.

Blunt trailing edge 40*i* describes or delimits edge face 54, an upper surface which is approximately orthogonal (i.e., approximately radial) with respect to axis a of shroud 50. Edge face 54 basically is even and level in terms of its "topography." With some approximation, edge face 54 is flat, linear, vertical and continuous.

Edge face 54 inventively acts so as to duct air down to shroud encirclement step 60. Edge face 54 should be of such shape as to allow the freestream flow of water to separate near its horizontal extremes at an appropriate minimum craft velocity, and should be of sufficient width to create a separation cavity with enough flow area to duct the needed air to shroud encirclement step 60.

Figure 19:
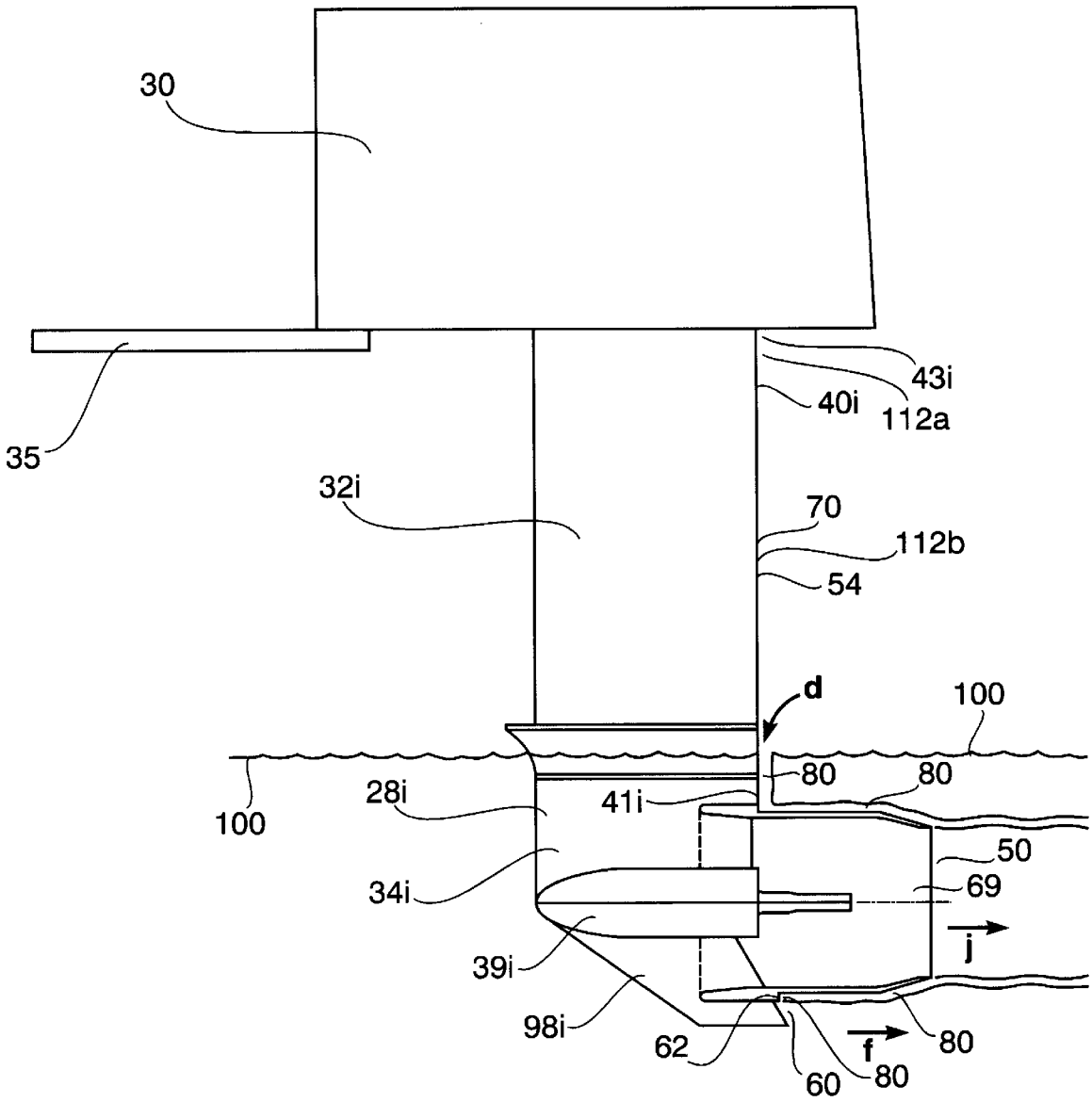
FIG. 19 is a more detailed version of the view shown in FIG. 3, illustrating fluid dynamic principles pertaining to operation of the present invention.
Figure 20:
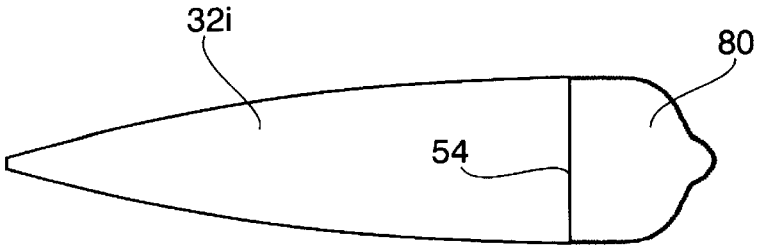
FIG. 20 is a diagrammatic horizontally cross-sectional view of a motor strut, illustrating fluid dynamic principles as shown in FIG. 19.
Figure 21:
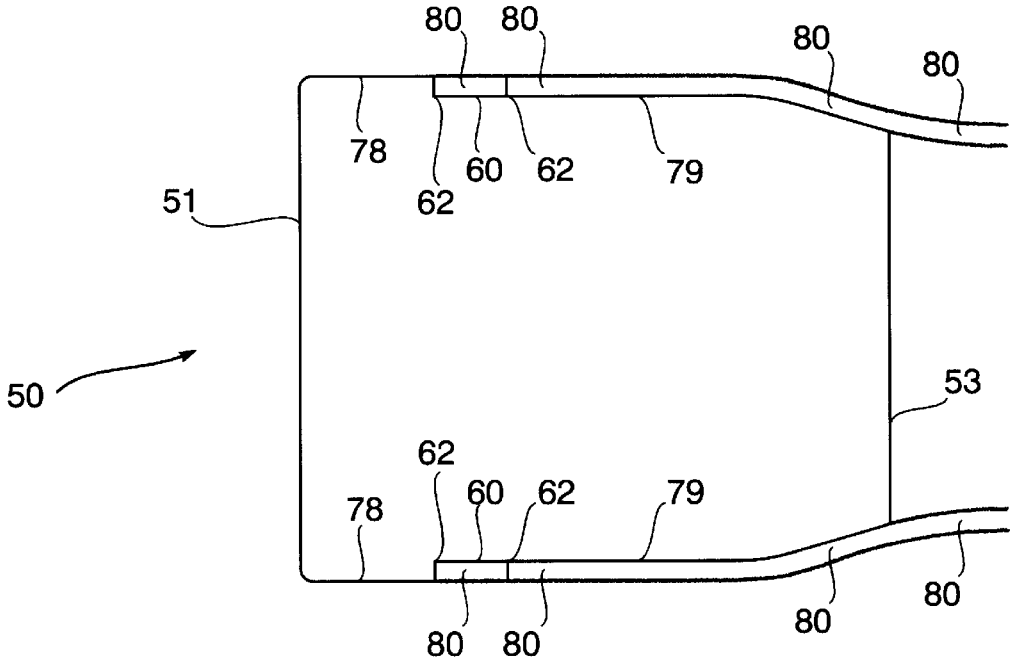
FIG. 21 is a diagrammatic top plan view (with some detail omitted) of an inventive shroud, illustrating fluid dynamic principles as shown in FIG. 19.
Figure 22:
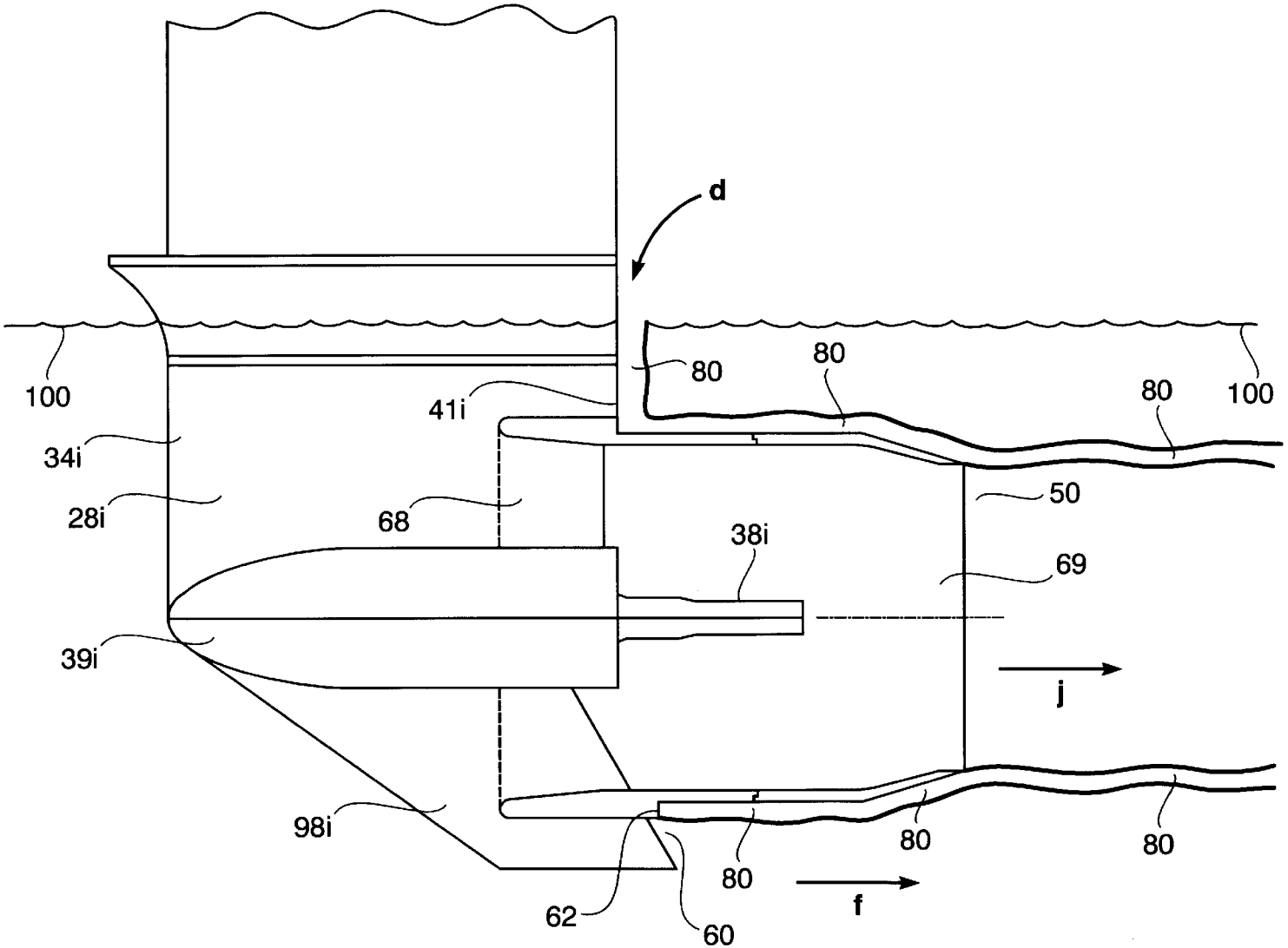
FIG. 22 is a partial and enlarged version of the illustrative view shown in FIG. 19.

As shown in FIG. 19 and FIG. 22, while the water craft is navigating, waterline 100 will generally fall above cavitation plate 42*i* and below the top of spray deflector 33*i*. Bottom end 41*i* of blunt trailing edge 40*i* is shown to be situated approximately one to three inches below cavitation plate 42*i*, which in turn is situated approximately one to two inches below waterline 100.

The majority of inventive embodiments provide an edge face 54 (which corresponds to the "blunt" portion of blunt trailing edge 40*i*) which extends upward from a lower edge face location which is approximately coincident with bottom end 41*i* of blunt trailing edge 40*i*. As shown in FIG. 19, edge face 54 of blunt trailing edge 40*i* extends upward all the way up to the bottom of motor 30—that is, all the way up to top end 43*i* of blunt trailing edge 40*i*. In other words, upper edge face location 112*a* and top end 43*i* are approximately coincident.

According to many inventive embodiments, however, edge face 54 does not extend upward as great a vertical distance as shown in FIG. 3 and FIG. 19. For instance, according to some inventive embodiments, blunt trailing edge 40*i* is not entirely "blunt." That is, some inventive embodiments provide an "abbreviated" edge face 54—that is, an edge face 54 which is not entirely coextensive with blunt trailing edge 40*i*.

Edge face 54 can be envisioned in FIG. 19, for example, to extend between bottom end 41*i* and upper edge face location 112*b*, which is considerably below top end 43*i*. According to such inventive embodiments, the portion of blunt trailing edge 40*i* which is above upper edge face location 112*b* can have any "non-blunt" shape of convenience, since it is sufficiently beyond the waterline 100 interface to impact the inventive fluid dynamics.

Preferably, for most inventive embodiments, edge face 54 of blunt trailing edge 40*i* will be maintained during navigation so as to extend between a bottom end 41*i* and an upper edge face location 112 whereby upper edge face location 112 is situated at a vertical distance of at least approximately nine inches above waterline 100 (wherein said vertical distance above waterline 100 will vacillate between, say, six and twelve inches).

Shroud encirclement step 60 is disposed around approximately the entire periphery of shroud 50. Encirclement step 60 "steps up" in a forward direction (and hence "steps down" in an aftward direction). Encirclement step 60 of shroud 50 describes or delimits step face 62, a ring-like or band-like lower surface which is approximately circumscriptive with respect to axis a of shroud 50, and which is continuous or nearly continuous.

Encirclement step 60 "mates" with blunt trailing edge 40*i*. At bottom end 41*i*, bottommost portion 64 of edge face 54 is (in terms of its surface) approximately even with, and thus effectively merges or blends with, topmost portion 66 of step face 62. Beginning from top end 43*i*, blunt trailing edge 40*i* proceeds downward a greater distance along strut 32*i*, then continues downward a lesser distance along lower gearcase unit 34*i* so as to be in proximity to, and approximately align with, topmost portion 66 of step face 62.

It can be considered that an imaginary plane (straight or curved) which passes through step face 62, transecting shroud 50, divides shroud 50 into two sections sharing axis a. Encirclement step 60 is disposed on the outside of shroud 50, at a location nearer shroud inlet 51 than shroud outlet 53, so as to divide shroud 50 into forward shroud section 68 and aft shroud section 69, wherein forward shroud section 68 has an appreciably greater general diameter than has aft shroud section 69. Forward shroud section is the diametrically "major" section; aft shroud section 69 is the diametrically "minor" section.

For many inventive embodiments, shroud 50 is blunter at shroud inlet 51 than at shroud outlet 53. Forward shroud section 68 has a generally thicker wall than has aft shroud section 69; thus, inlet lip 96 at shroud inlet 51 is blunter in comparison with outlet lip 97 at shroud outlet 53. This thickening toward shroud inlet 51, wherein the inlet lip 96 geometries are less sharp, allows for a wider range of flow conditions into shroud inlet 51.

In general inventive practice, step face 62 proceeds "circumferentially" around the shroud in the sense that, entirely or to a substantial extent, it loops around or encircles the shroud in smooth and unbroken fashion. With reference to FIG. 5 through FIG. 9, the present invention admits of a diversity of configurations of shroud encirclement step 60. For most inventive embodiments, regardless of the configurational embodiment of step 60, step 60 will exhibit a kind of lateral symmetry with respect to axis a of shroud 50.

Generally speaking, in accordance with this invention, the geometrical configuration of step face 62 can be considered in various aspects. Regardless of how step face 62 is inventively embodied, the objective generally remains to further the fluid dynamic principles of this invention—in particular, to promote air circulation about shroud 50 in an inventively propitious manner.

Basically, step face 62 lends itself to variation in any combination of one, two, three, four or all five of the following aspects: (i) in terms of the overall, top-to-bottom shape (e.g., in terms of linearity versus curvilinearity) of step of face 62; (ii) in terms of the overall, top-to-bottom disposition of step face 62 in relation to axis a of shroud 50; (iii) in terms of the shape of step face 62 between forward shroud surface 78 (which is the exterior circumferential surface of forward shroud section 68) and aft shroud surface 79 (which is the exterior circumferential surface of aft shroud section 69); (iv) in terms of the disposition of step face 62 in relation to forward shroud surface 78 and aft shroud surface 79; and, (v) in terms of constancy versus variability of the "height" of step 62 in accordance with the circumferential location around step 62, wherein the "height" refers to a real or projected perpendicular distance between forward shroud surface 78 and aft shroud surface 79.

With regard to the overall, top-to-bottom shape and disposition of step face 62, depending upon the inventive embodiment, step face 62 can be considered to approximately define either a curved (arched or cambered) imaginary surface (contour) or a flat (planar or level) imaginary surface (contour) which passes therethrough so as to traverse the shroud's axis a and transect shroud 50. In inventive practice, the imaginary surface defined by step face 62, whether curved or flat and regardless of angularity in relation to axis a, is preferably approximately symmetrical with respect to an imaginary vertical plane which passes through axis a.

FIG. 5 through FIG. 9 represent how the overall configuration of step face 62 can exhibit distinguishible characteristics. Firstly, step face 62, considered top-to-bottom (taken as a whole), can be considered to essentially define either a flat plane or a curved plane. In other words, viewed from the side, step face 62 essentially defines either a "straight" line or a "cambered" line. Secondly, step face 62, again considered top-to-bottom, can be considered to essentially define a plane which manifests either perpendicularity or obliqueness with respect to axis a of shroud 50; that is, this plane can either be vertical, or angled fore or aft. For many inventive embodiments, the fore-and-aft angling of this plane, generally defined by entire step 62, may improve the air flow delivery.

Depending on the inventive embodiment, the curved or flat plane approximately defined by step face 62 can manifest diverse angularities. Generally speaking, preferred inventive practice will effectuate such an inclination which does not excessively deviate from ninety degrees; that is, the inclination should be in furtherance of, and should not be so great as to compromise, the fluid dynamic principles of this invention.

Usually, the inclination of the plane with respect to axis a of shroud 50 will manifest an angle θ which ranges approximately between forty-five degrees (wherein topmost portion 66 of step face 62 is aft of bottommost portion 67 of step face 62) and one hundred thirty-five degrees (wherein topmost portion 66 of step face 62 is forward of bottommost portion 67 of step face 62); in other words, this inclination will typically not deviate more than plus-or-minus forty-five degrees from verticality (i.e., perpendicularity or orthogonality with respect to axis a).

Figure 5:
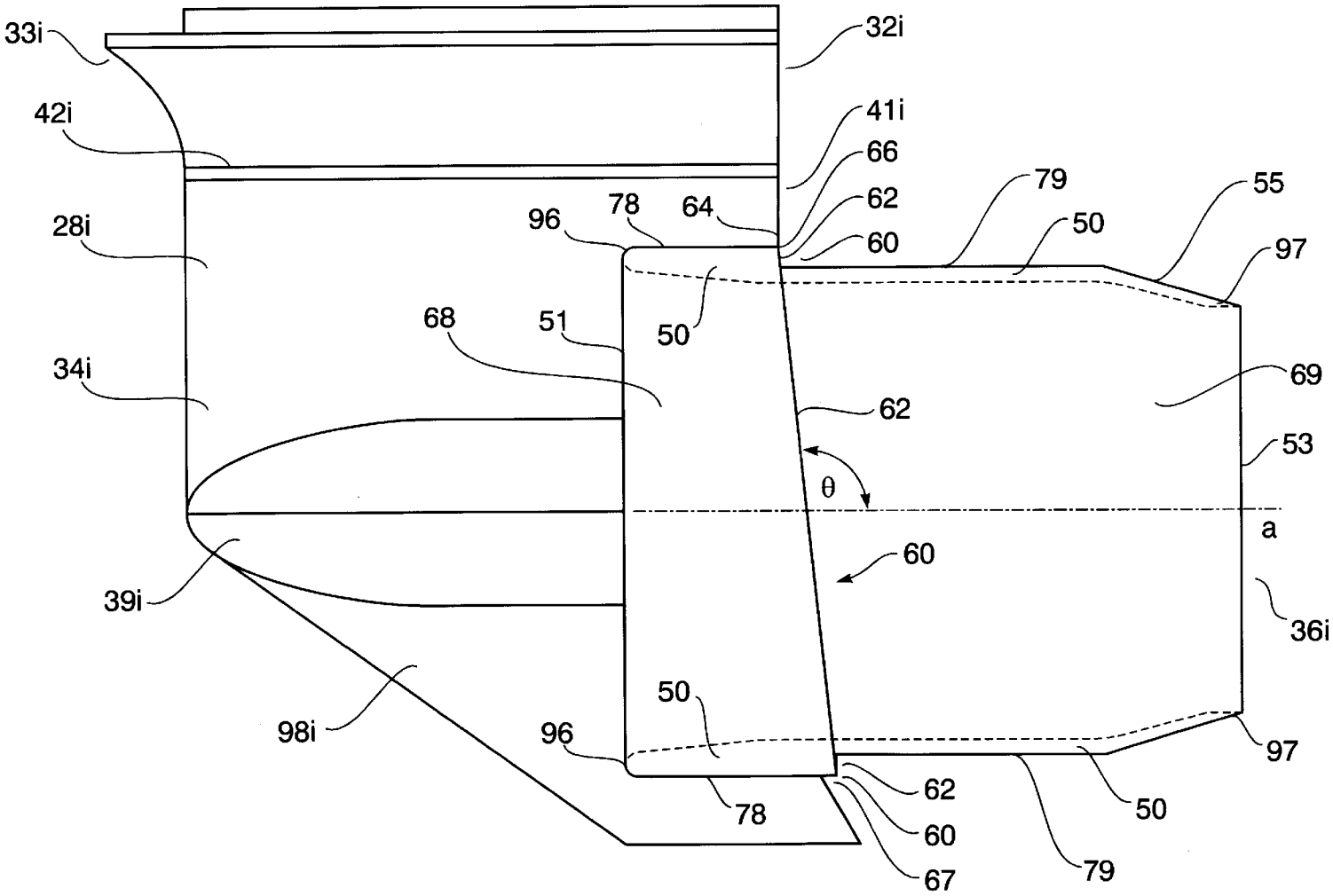
FIG. 5 is a view, similar to to view shown in FIG. 4, of an inventive embodiment such as shown in FIG. 3, wherein the shroud's step has a straight, oblique top-to-bottom disposition.
Figure 6:
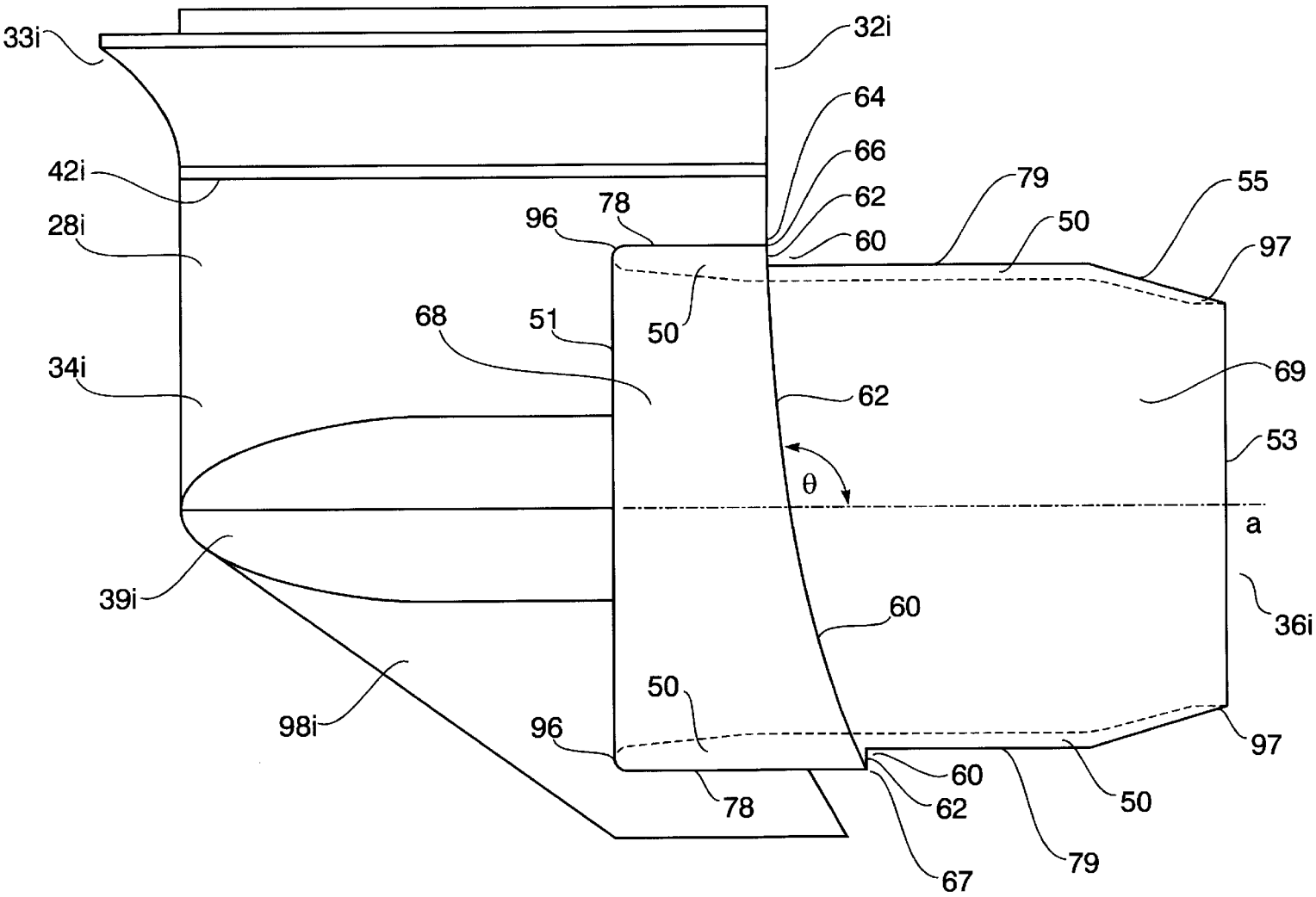
FIG. 6 is a view, similar to to view shown in FIG. 4, of an inventive embodiment such as shown in FIG. 3, wherein the shroud's step has a cambered top-to-bottom disposition.

As shown in FIG. 5 and FIG. 6, topmost portion 66 of step face 62 is forward of bottommost portion 67 of step face 62.

Step face 62 shown in FIG. 5 is "straight," whereas step face 62 shown in FIG. 6 is "cambered." That is to say, step face 62 shown in FIG. 5 essentially lies in a flat plane which intersects axis a, while step face 62 shown in FIG. 6 essentially lies in a curved plane which intersects axis a. Step face 62 shown in FIG. 5 and FIG. 6 essentially describes an oblique angle θ with respect to axis a.

Figure 7:
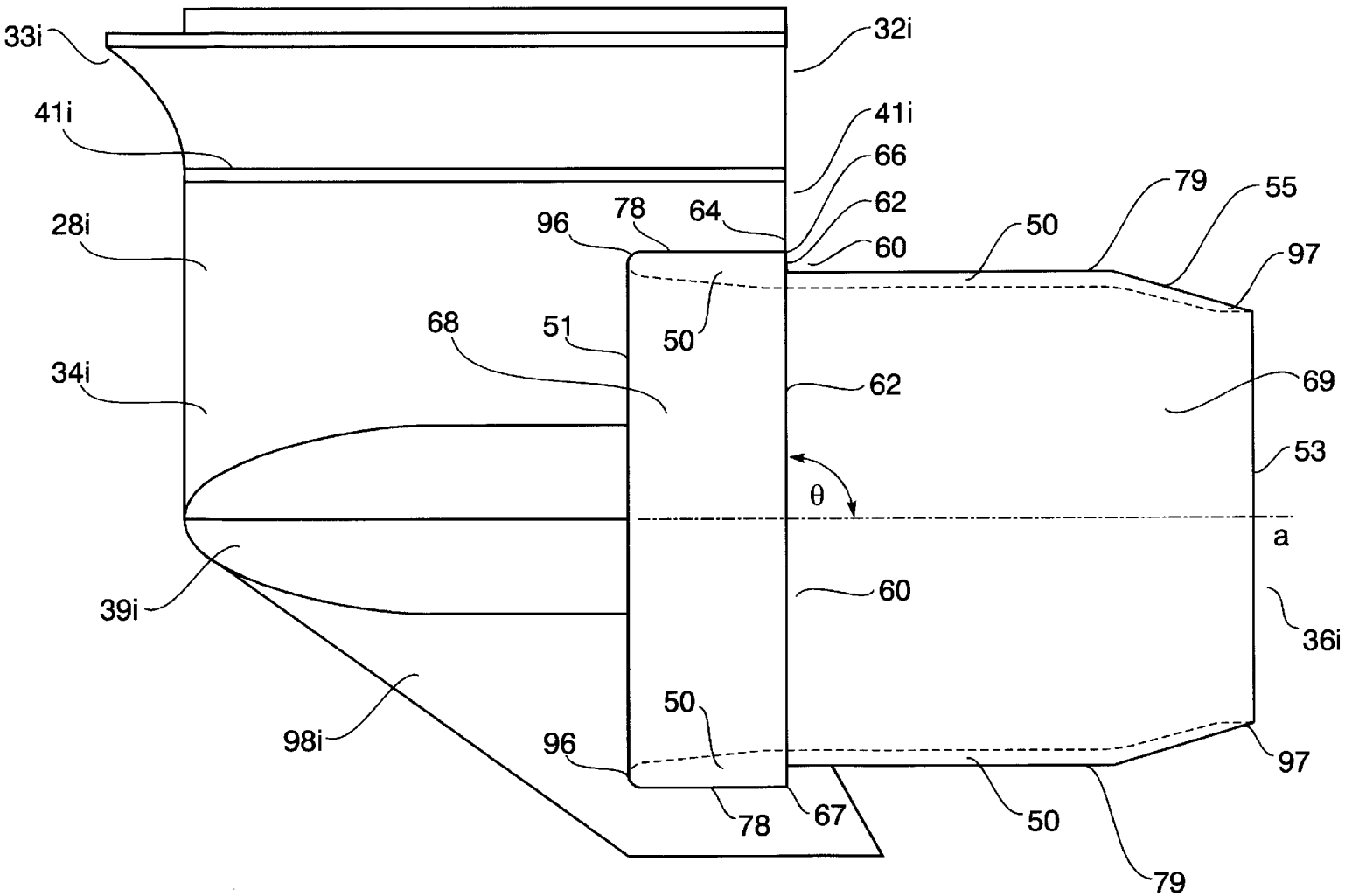
FIG. 7 is a view, similar to to view shown in FIG. 4, of an inventive embodiment similar to that shown in FIG. 3, wherein the bottom area of the shroud's step is vertically even with the top area thereof, and wherein the shroud's step has a vertically straight top-to-bottom disposition.
Figure 8:
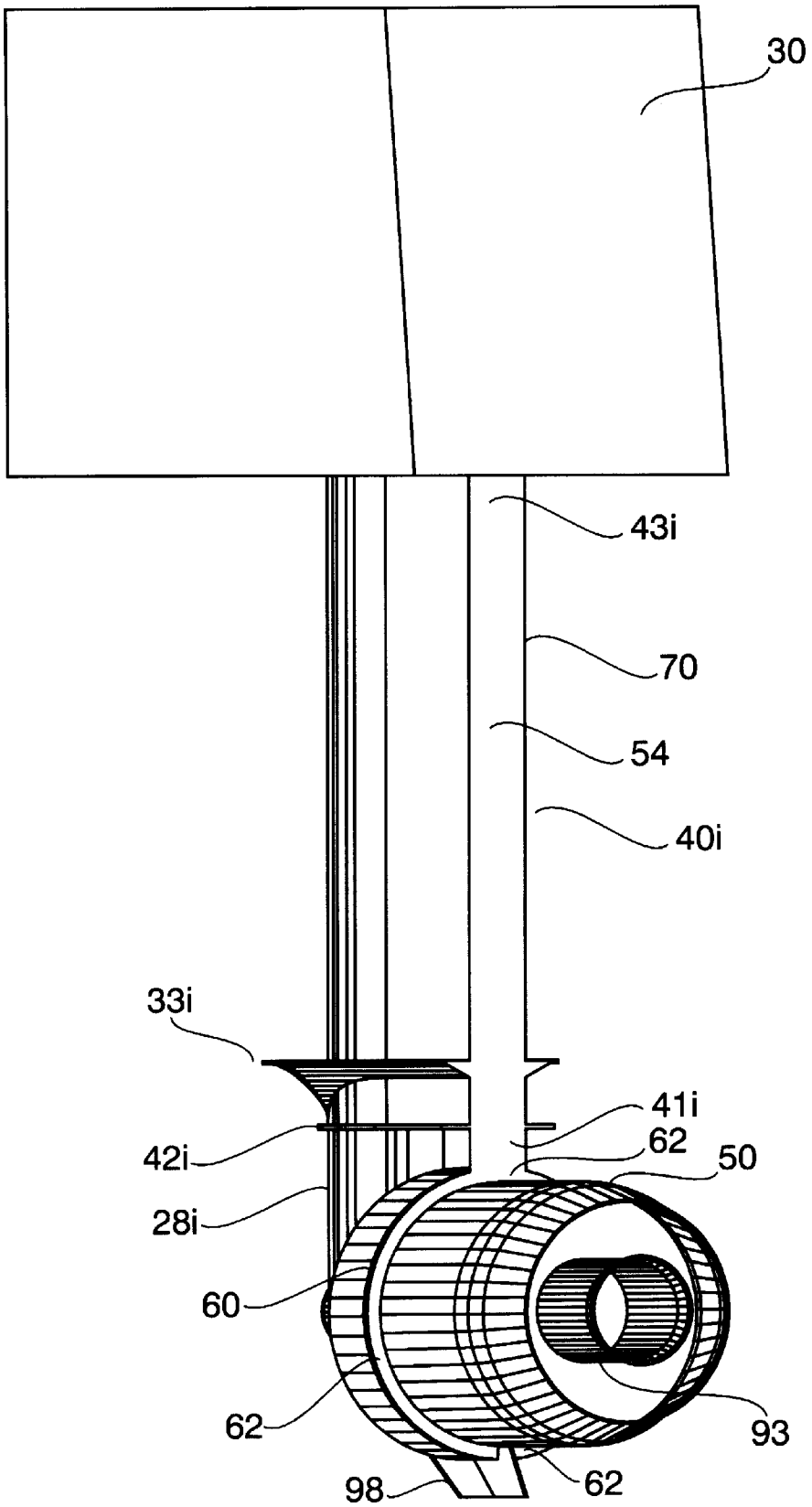
FIG. 8 is a diagrammatic perspective view of the inventive embodiment shown in FIG. 7.
Figure 9:
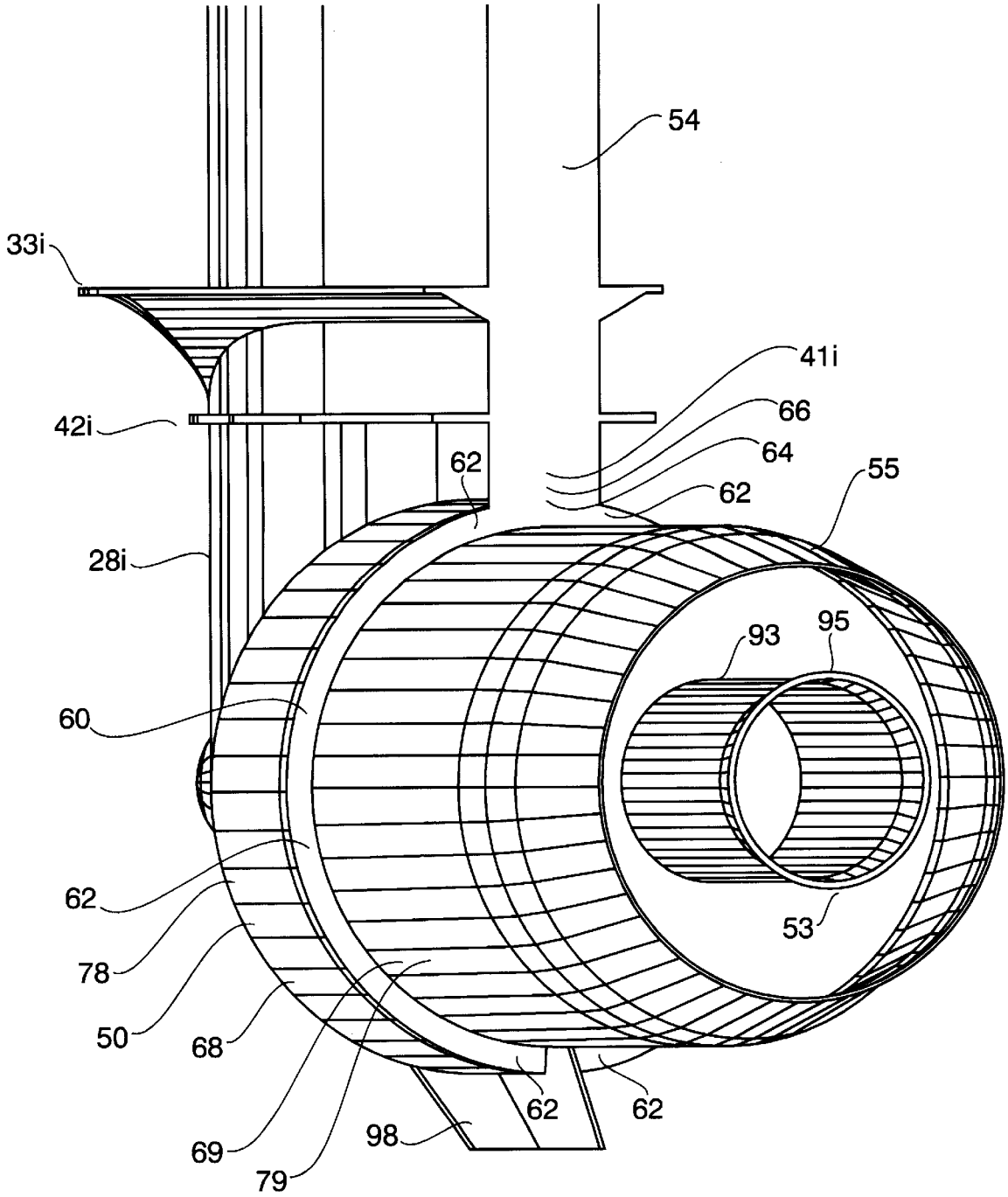
FIG. 9 is a partial and enlarged version of the view shown in FIG. 8.

Step face 62 shown in FIG. 7 through FIG. 9 essentially describes a right angle θ with respect to axis a. As shown in FIG. 7 through FIG. 9, topmost portion 66 of step face 62 is straight and is vertically aligned with of bottommost portion 67 of step face 62. Step face 62 shown in FIG. 7 through FIG. 9 essentially lies in a flat plane which orthogonally intersects axis a.

Reference now being made to FIG. 10 through FIG. 15, in accordance with the present invention, step face 62 can be variously configured when considered in the direction therealong between forward shroud surface 78 and aft shroud surface 79. In each of FIG. 10 through FIG. 15, forward shroud surface 78 and aft shroud surface 79 are shown to be approximately parallel in the vicinity of step face 62.

Figure 10:
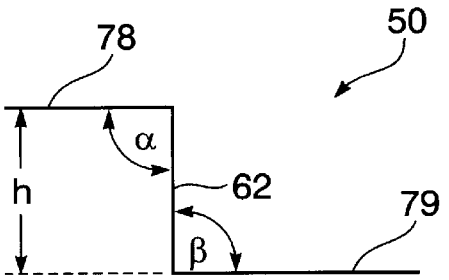
FIG. 10 through FIG. 15 are diagrammatic side elevational views of various inventive embodiments of the shroud's step face.
Figure 11:
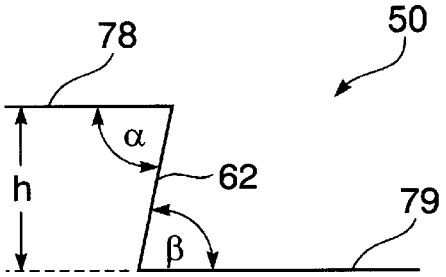
Figure 12:
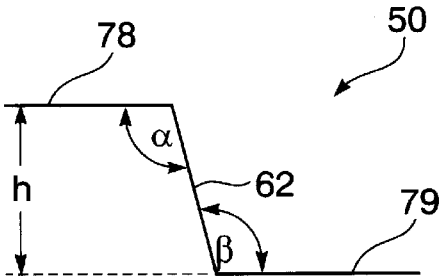

Generally, FIG. 10, FIG. 11, FIG. 12, FIG. 13 and FIG. 15 are each characterized by linearity; FIG. 14 is characterized by both linearity and curvilinearity. In FIG. 10 through FIG. 12, step face 62 can be considered to include one "line segment." In FIG. 14 and FIG. 15, step face 62 can be considered to include two "line segments." In FIG. 13, step face 62 can be considered to include three "line segments."

In each of FIG. 10 through FIG. 12, step face 62 is shown to essentially describe a single straight line segment. Step face 62 shown in FIG. 10 describes a single straight vertical line segment which is disposed approximately perpendicularly with respect to both forward shroud surface 78 and aft shroud surface 79. Step face 62 shown in each of FIG. 11 and FIG. 12 describes a single straight tapered (non-vertical) line segment which is disposed at an approximately equal oblique angle with respect to both forward shroud surface 78 and aft shroud surface 79. Step face 62 shown in FIG. 11 is tapered forward, whereas step face 62 shown in FIG. 12 is tapered aft. Depending on the inventive embodiment, the fore or aft angling of step face 62 may aid in the ducting of air flow around shroud step 60.

Figure 13:
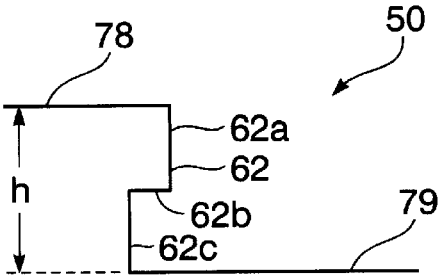
Figure 14:
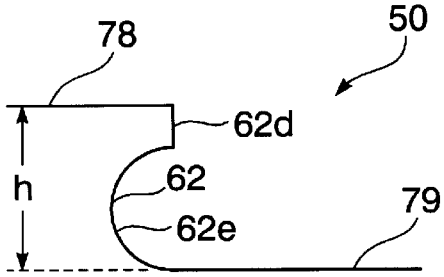
Figure 15:
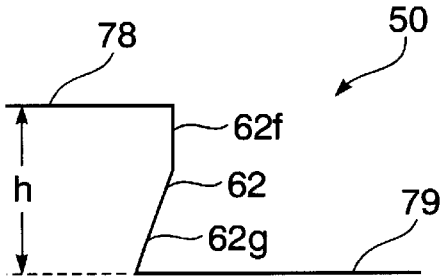

FIG. 13, FIG. 14 and FIG. 15 show similar step face 62 arrangements insofar as each step face 62 is "undercut" for purposes of promoting air circulation.

In FIG. 13, step face 62 essentially describes three adjacent straight line segments. Upper step face segment 62*a* perpendicularly meets forward shroud surface 78. Lower step face segment 62*c* perpendicularly meets aft shroud surface 79. Intermediate step face segment 62*b* perpendicularly meets both upper step face segment 62*a* and lower step face segment 62*c*, and is parallel to both forward shroud surface 78 and aft shroud surface 79.

In FIG. 14, step face 62 essentially describes two adjacent line segments, one of which is straight and the other of which is curved. Upper step face segment 62*d* is straight and perpendicularly meets forward shroud surface 78. Lower step face segment 62*e* is curved and smoothly meets aft shroud surface 79.

In FIG. 15, step face 62 essentially describes two straight adjacent line segments. Upper step face segment 62*f* perpendicularly meets forward shroud surface 78. Lower step face segment 62*g* obliquely meets aft shroud surface 79.

It may be useful to consider an inventive "rule of thumb" regarding the angularity of step face 62 with respect to forward shroud surface 78 and/or aft shroud surface 79. Such consideration may be more meaningful when step face 62 describes a straight line segment, or a plurality of adjacent straight line segments, wherein step face 62 can more readily be conceived to describe a single, representative, overall line segment. For many inventive embodiments, the angle which is formed by step face 62 and forward shroud surface 78 (such as angle a shown in FIG. 10 through FIG. 12), and/or the angle which is formed by step face 62 and aft shroud surface 79 (such as angle β shown in FIG. 10 through FIG. 12) should range between thirty degrees (30° ) and one-hundred fifty degrees (150° ).

Figure 16:
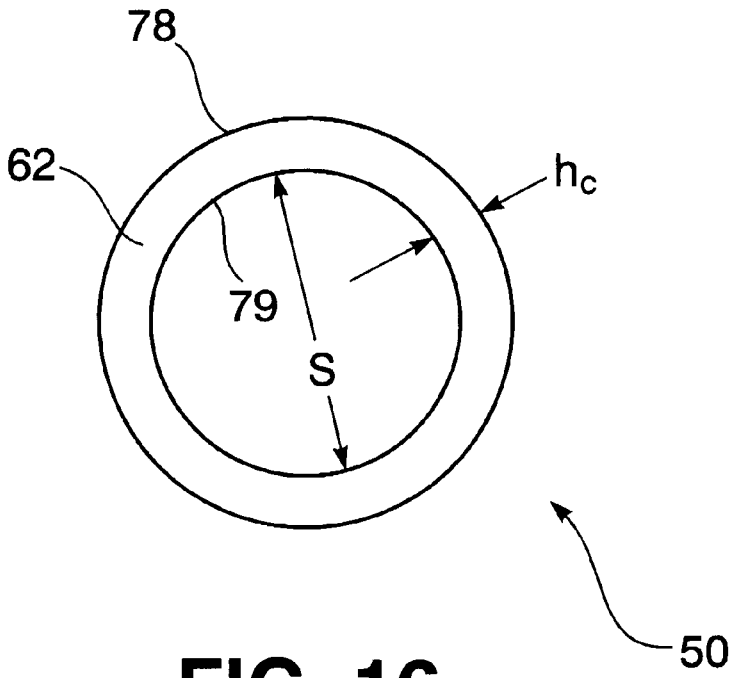
FIG. 16 is a diagrammatic end view (with some detail omitted) of an inventive shroud embodiment characterized by constancy of height of the shroud's step face.
Figure 17:
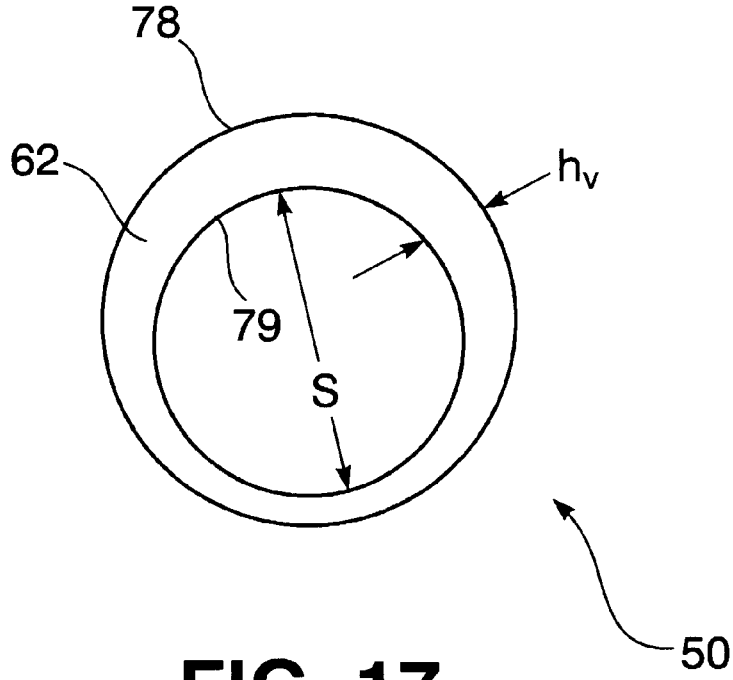
FIG. 17 is a diagrammatic end view (with some detail omitted) of an inventive shroud embodiment characterized by nonconstancy of height of the shroud's step face.

Height h of step face 62 can be constant or variable, in accordance in this invention. With reference to FIG. 16 and FIG. 17, step face 62 can either have a constant height $h_c$ (as shown in FIG. 16) or a variable height $h_v$ (as shown in FIG. 17). Whether and in what manner step face 62 is characterized by variability of height $h_v$ is dictated by factors including flow conditions and the required air flow at one or more particular locations.

Typical inventive practice will provide a measurement of height h of step face 62 which is less than or equal to approximately five percent (5%) of the measurement of shroud diameter s (shown in FIG. 16 and FIG. 17), wherein s equals the greatest diameter of aft shroud section 69 ( i.e., wherein the measurement is taken around aft shroud surface 79 so as to yield the maximum diametric value at any point along aft shroud surface 79). Regardless of whether height h of step face 62 is a constant height $h_c$ or a variable height $h_v$, height h should be sufficient at all points around the circumference of step face 62 so that air may be guided accordingly in a complete or substantially complete "circle."

Height h of step face 62 will, generally, at least somewhat relate to inlet lip 96 of shroud 50. Structurally speaking, the configuration of shroud inlet lip 96 will to some extent determine height h. For instance, a thicker inlet lip 96 will, in the sense of the overall structure of shroud 50, generally permit a greater height h.

Fluid dynamically speaking, certain configurational aspects of shroud 50, such as shroud inlet lip 96 and step 60, should be designed with flow conditions in mind. For instance, the ordinarily skilled inventive practitioner who reads this disclosure will be aware that shroud inlet lip 96 should have suitable curvature for avoiding flow separation from either the outside surface, or the inside surface, of shroud 50. Also, the ordinarily skilled inventive practitioner who reads this disclosure will be aware that there may be a fluid dynamic interplay or interrelationship between inlet lip 96 and height h. In these and similar regards, persons who are of ordinary skill in the pertinent art(s) can, in the light of this disclosure, bring to bear their knowledge of and familiarity with analytical methodologies such as those involving computational fluid dynamics.

In the light of this disclosure, the ordinarily skilled artisan would be expected to have the capability of practicing, without undue experimentation, the inventive aspects pertaining genera to the shape of shroud 50, and particularly to various characteristics of step face 62 (such as height h) in relation to various factors (such as navigational flow conditions) and various other characteristics of shroud 50 (such as shroud inlet lip 96).

Moreover, it is readily understood by the ordinarily skilled artisan who reads this disclosure that the present invention encompasses multifarious variations of the geometrical configuration of step face 62. In the light of this disclosure, numerous and diverse geometrical configurations of step face 62 which are not exemplified herein will be apparent to the ordinarily skilled artisan.

Figure 18:
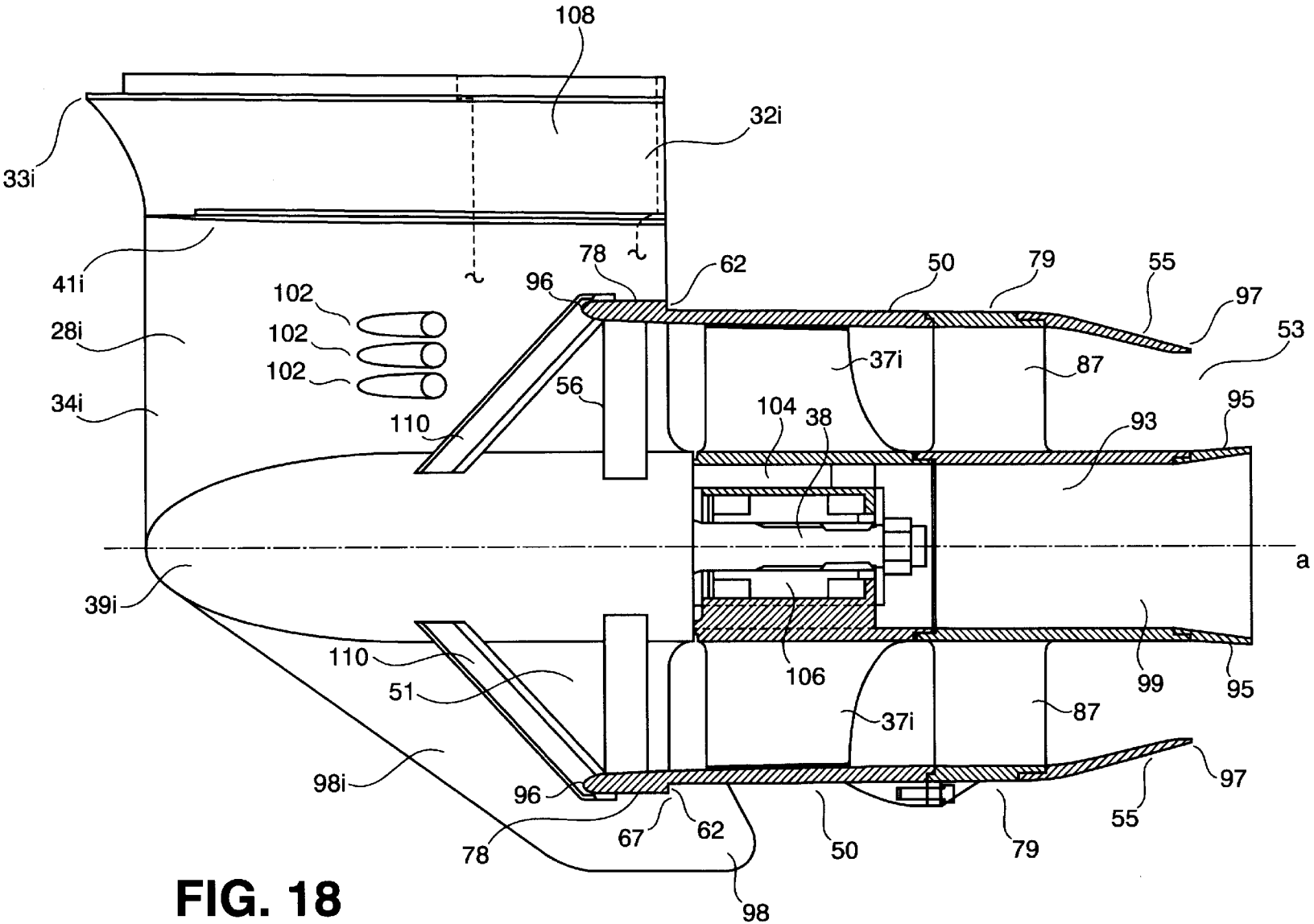
FIG. 18 is a cutaway version of the view shown in FIG. 7.

Now referring to FIG. 18, pumpjet unit 36*i* has certain indicia typical of outboard motor-mounted pumpjets, particulary insofar as having the rotating impeller or rotor (viz., impeller 37*i*) enclosed in a shroud or duct (viz., shroud 50). Since a pumpjet impeller is not an open propeller, it becomes appropriate to design the pumpjet impeller in light of pump design theory, which accounts for the presence of the surrounding inner shroud surface. Hence, certain marine engineering principles, devices and techniques which are normally associated with pumpjet propulsion are still appropriate for many embodiments of the inventive pumpjet propulsor.

Shroud 50 typifies conventional practice pertaining to utilization of impeller shrouds or ducts in general, insofar as the overall length of shroud 50 is on the order of one to one-and-one-half (1 to 1.5) times the diameter of shroud 50. In addition, aft shroud surface 79 is quasi-cylindrical in shape and, at least substantially, is smooth and continuous.

Shroud 50 has shroud inlet 51 (forward of impeller 37*i*) and shroud outlet 53 (aft of impeller 37*i*). Shroud inlet lip 96 is thicker and blunter than is shroud outlet lip 97. Shroud 50 extends forward of impeller 37*i* (to shroud inlet 51), thereby promoting efficiency of ducting flow into impeller unit 36*i*.

Nozzle section 55 is the "converging" aft-end portion of shroud 50. As shroud 50 extends aft of stator 87 (approaching shroud outlet 53), the diameter of shroud 50 gradually decreases, thus describing nozzle section 55. Nozzle section 55 acts to accelerate the pumpjet flow, shown to be generally in direction j, to the desired jet flow velocity for producing thrust.

The invention implements several parts and components which are typical of conventional jetpump-type propulsion apparatus. For instance, impeller 37*i* is a rotor having a plurality of (e.g., five) rotor blades. Stator 87 has a plurality of (e.g., seven) stator vanes. Tailcone 93, a conventional pumpjet component, is aft of and complements hub 29. Tailcone 93 has exhaust channel 99. Tailcone extension 95, the "diverging" aft-end portion of tailcone 93, for some embodiments gradually increases in diameter such as shown.

A skeg-type structure not unlike skeg 98 is typically seen in conventional practice. Skeg 98*i* extends aft of bottommost portion 67 of step face 62. Skeg 98*i* should not significantly interfere with inventive air circulation when inventively implemented with most embodiments. Also typically associated with many conventional outboard propulsors are elements such as cooling water intakes 102, exhaust passage 104 and bushing 106.

Many water vehicle propulsion systems provide for a through-hub channeling of engine exhaust. Passage means such as engine-exhaust duct 108 can be provided for such purposes.

Typically, in conventional practice vanes are positioned inside an impeller shroud/duct. In accordance therewith, inlet straightening vanes 56 and flow deswirling stator vanes 87 are placed inside shroud 50, forward and aft of impeller 37*i*, respectively. However, vanes such as inlet debris vanes 110 are not seen in conventional practice; rather, inlet debris vanes 110 are unique, novel vane-like structures which are shown to be inventively implemented in FIG. 18.

Now referring to FIG. 19 through FIG. 22, the invention represents an uncomplicated methodology for ventilating the outer shroud of a pumpjet with atmospheric air so as to reduce its drag and improve overall performance. The invention uses a blunt trailing edge to feed atmospheric air to the shroud's step. The blunt trailing edge, extending from the motor strut down to a mating step on the submerged shroud, induces separation while the craft is underway; consequently, a vapor cavity will be formed which draws in surface air and unwets the aft outer shroud.

By way of elaboration, during navigation of the marine craft, step 60 is normally situated below water line 100, while most of blunt trailing edge 40*i* is situated above water line 100. Cavitation plate 42*i* is normally situated about an inch or two below water line 100. Pumjet flow is generally in direction j. Freestream flow is generally in direction f.

In inventive operation, step 60 and blunt trailing edge 40*i* work in conjunction. As craft speed increases, the water flow separates from aft-facing surface 70 in two regions, viz., both (i) along bottom portion 64 of edge face 54 and (ii) around step face 62. This separation correspondingly causes the formation of vapor cavity 80, between the water flow and aft-facing surface 70, in both regions (i.e., extending (i) along bottom portion 64 of edge face 54 and (ii) around step face 62).

Vapor cavity 80 provides a path which draws in atmospheric surface air (such air shown being drawn in generally in direction d) so as to continually fill vapor cavity 80. Once sufficient craft speed is attained, vapor cavity 80 will extend to cover the remaining length of aft shroud section 69 (the portion of shroud 50 aft of step face 62). Vapor cavity 80 fills with air which unwets aft shroud section 69 and reduces drag.

The backward distance which vapor cavity 80 extends varies in accordance with craft speed. Hence, at lower craft speeds, vapor cavity 80 extends aftward behind step face 62 but before shroud outlet 53; at higher craft speeds, vapor cavity 80 extends aftward to and behind shroud outlet 53.

The venting of atmospheric air into vapor cavity 80 increases cavity pressure, which will reduce the profile drag of shroud 50. The layer of air surrounding aft shroud section 69 will extend and flow beyond the approximately vertical plane defined by shroud outlet 53, and will separate the nozzle jet flow j from the surrounding freestream flow f; this separation will minimize mixing losses between the two flows j and f, thereby enhancing performance.

Emphasized in this disclosure are "outboard-outboard" propulsion arrangements—i.e., propulsion arrangements wherein both the motor and the propulsor are situated outboard. However, the principles of the present invention are also applicable to "inboard-outboard" propulsion arrangements—i.e., propulsion arrangements wherein the motor is situated inboard but the propulsor is situated outboard. For instance, a type of "inboard-outboard" propulsion arrangement known as a "Z-drive" implements a short vertical motor strut which is similar in design principle and cross-section to the longer vertical motor strut normally associated with "outboard-outboard" propulsion arrangements.

In the light of this disclosure, the ordinarily skilled artisan should be capable of practicing the present invention not only in relation to "outboard-outboard" propulsion arrangements but also in relation to "inboard-outboard" propulsion arrangements. Regardless of the placement of the motor, so long as a given propulsion arrangement includes an outboard propulsor, construction and/or adaptation and/or implementation in accordance with the present invention should be within the capacity of the ordinarily skilled artisan who reads this disclosure.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. Apparatus for enhancing fluid dynamic efficiency of a water craft which implements an outboard impeller near the stern of said water craft, said apparatus comprising an impeller duct outside surface region and a generally rearward surface region, said generally rearward surface region being for promoting atmospheric ventilation of said impeller duct outside surface region during navigation of said water craft, said generally rearward surface region including an elongated approximately upright upper surface subregion and a flange-shaped lower surface subregion, said impeller duct outside surface region having a front end and a rear end, said lower surface subregion at least substantially encircling said impeller duct outside surface region approximately at said front end.

2. Apparatus for securing an outboard impeller as in claim 1, wherein said impeller duct outside surface region has an approximate axis of symmetry, and wherein said front end approximately defines a circular rim which shares said axis and which interiorly borders upon said lower surface subregion.

3. Apparatus for securing an outboard impeller as in claim 2, wherein said circular rim approximately defines a disk which is approximately perpendicular to said axis.

4. Apparatus for securing an outboard impeller as in claim 2, wherein said circular rim approximately defines a disk which is oblique with respect to said axis.

5. A marine propulsion system for engaging an outboard motor, said system comprising:

a unit which includes a pumpjet and a curvilinear shroud which is characterized by approximate axial symmetry, said shroud having a step which is disposed perimetrically at least substantially around the periphery of said shroud; and a strut which projects below said motor and supports said unit;

wherein a blunt trailing edge is disposed in at least one of said strut and said unit, said blunt trailing edge delimiting an upper wall which is approximately linear and approximately vertical, said step delimiting a lower wall which is approximately ring-shaped, said upper wall having a bottom end segment, said lower wall having a top arcuate segment, said bottom end segment and said top arcuate segment at least substantially evenly connecting, said upper wall and said lower wall together describing an aggregate wall which, to at least a substantial degree, is even and continuous.

6. A propulsion assembly for an outboard motor situated in the vicinity of the stem of a marine vessel, said marine vessel having associated therewith a fore, an aft and a centerline, said propulsion assembly comprising:

an impeller device which includes a covering, said covering being approximately symmetrical about an axis which is approximately parallel to said centerline; and a member which extends generally downward from said outboard motor and which joins said outboard motor with said impeller device;

wherein the combination of said member and said covering includes a generally aft-facing surface which is at least substantially continuous and at least substantially even, said aft-facing surface including an approximately linear first surface portion and a curvilinear second surface portion, said first surface portion being approximately perpendicular to said axis and at least substantially extending between said outboard motor and said covering, said second surface portion being curvilinear and at least substantially encircling said axis.

7. A propulsion assembly as in claim 6 wherein, when said marine vessel travels, atmospheric air circulates along said aft-facing surface so as to ventilate said covering, thereby reducing drag related to said covering.

8. A propulsion assembly as in claim 6, wherein said member includes at least a substantial part of said first surface portion.

9. A propulsion assembly as in claim 6, wherein said covering includes at least a substantial part of said second surface portion.

10. A marine propulsion system comprising motor means, impeller means and housing means; said housing means connectively situated below said motor means and housing said impeller means; said housing means including an approximately vertical approximately straight approximately planar trailing edge; said impeller means including shrouding means; said shrouding means including a diametrically larger longitudinal section, a diametrically smaller longitudinal section and an annular precipitous section; said annular precipitous section being conjunctive with respect to said diametrically larger longitudinal section and said diametrically smaller longitudinal section; said diametrically larger longitudinal section and said diametrically smaller longitudinal section each being approximately symmetrical with respect to the same imaginary approximately horizontal longitudinal axis; said approximately vertical approximately straight approximately planar trailing edge descendently converging approximately flushly into said annular precipitous section; said approximately vertical approximately straight approximately planar trailing edge and said annular precipitous section thereby together forming an approximately even approximately continuous fluid dynamic surface.

11. A marine propulsion system as in claim 10, wherein said annular precipitous section approximately defines a curved imaginary surface which passes through said annular precipitous section so as to traverse said imaginary approximately horizontal longitudinal axis.

12. A marine propulsion system as in claim 11, wherein said curved imaginary surface approximately manifests an inclination, with respect to said imaginary approximately horizontal longitudinal axis, which ranges approximately between negative forty-five degrees and positive forty-five degrees, said inclination measured in the imaginary vertical plane which passes through said imaginary approximately horizontal longitudinal axis.

13. A marine propulsion system as in claim 11, wherein said annular precipitous section approximately manifests an inclination, with respect to one of said diametrically larger longitudinal section and said diametrically smaller a longitudinal section, which ranges approximately between negative thirty degrees and positive thirty degrees.

14. A marine propulsion system as in claim 10, wherein said annular precipitous section approximately defines a flat imaginary surface which passes through said annular precipitous section so as to traverse said imaginary approximately horizontal longitudinal axis.

15. A marine propulsion system as in claim 14, wherein said flat imaginary surface approximately manifests an inclination, with respect to said imaginary approximately horizontal longitudinal axis, which ranges approximately between negative forty-five degrees and positive forty-five degrees, said inclination measured in the imaginary vertical plane which passes through said imaginary approximately horizontal longitudinal axis.

16. A marine propulsion system as in claim 14, wherein said annular precipitous section approximately manifests an inclination, with respect to one of said diametrically larger longitudinal section and said diametrically smaller longitudinal section, which ranges approximately between negative thirty degrees and positive thirty degrees.

17. A method for converting an outboard open propeller-type marine propulsion system to an outboard pumpjet-type marine propulsion system, said outboard open propeller-type marine propulsion system including a motor, a strut which is adjoinedly placed below said motor, and a gearcase unit which is adjoinedly placed below said strut, said strut having an irregular aft-side configuration, said gearcase unit including a propeller and a rotatable shaft to which said propeller is attached, said method comprising:

reshaping said strut so that said strut has a regular aft-side configuration which is approximately flat, approximately linear and approximately vertical;

removing said propeller;

attaching an impeller to said shaft; and integrating with said gearcase unit a curvilinear shroud which is approximately axially-symmetrical, said shroud having a step which is disposed perimetrically at least substantially around the periphery of said shroud, said integrating including associating said shroud with said regular aft-side configuration whereby the combination of said shroud and said regular aft-side configuration describes a generally aftward surface which is characterized by at least a substantial degree of evenness and at least a substantial degree of continuity.

18. A method for converting as in claim 17, wherein said reshaping includes truncating said strut.

* * * * *